US005949194A

United States Patent [19]

Kawakami et al.

[11] Patent Number: 5,949,194

[45] Date of Patent: Sep. 7, 1999

[54] DISPLAY ELEMENT DRIVE METHOD

[75] Inventors: Haruo Kawakami; Yotaro Shiraishi; Makoto Kobayashi, all of Kanagawa, Japan

[73] Assignee: Fuji Electric Co., Ltd., Kawasaki, Japan

[21] Appl. No.: 08/856,809

[22] Filed: May 15, 1997

[30] Foreign Application Priority Data

May 16, 1996 [JP] Japan ..... 8-121172

[51] Int. Cl.[6] ..... G09G 3/34; G09G 3/10

[52] U.S. Cl. ..... 315/169.4; 315/169.3; 315/169.1; 345/76; 345/82

[58] Field of Search ..... 315/169.1, 169.4, 315/169.3; 345/76, 82, 36, 49

[56] References Cited

U.S. PATENT DOCUMENTS

| | | | |
|---|---|---|---|
| 4,819,038 | 4/1989 | Alt | 357/4 |
| 5,081,400 | 1/1992 | Weber et al. | 315/169.4 |
| 5,349,366 | 9/1994 | Yamazaki et al. | 345/92 |
| 5,608,666 | 3/1997 | Inushima et al. | 365/112 |
| 5,747,930 | 5/1998 | Utsugi | 313/504 |

FOREIGN PATENT DOCUMENTS

| | | |
|---|---|---|
| 55-28247 | 2/1980 | Japan . |
| 60-151992 | 8/1985 | Japan . |
| 06083284 | 3/1994 | Japan . |
| 06301355 | 10/1994 | Japan . |
| 07134558 | 5/1995 | Japan . |

*Primary Examiner*—Don Wong
*Assistant Examiner*—Wilson Lee
*Attorney, Agent, or Firm*—Kanesaka & Takeuchi

[57] ABSTRACT

A method to drive a display-element reduces the possibility of a sticking screen and ensures a high-quality display. A current flowing through each of the pixels constituting a display element is controlled so as to be maintained at a value required for a display operation.

11 Claims, 5 Drawing Sheets

DISPLAY ELEMENT DRIVE METHOD

BACKGROUND OF THE INVENTION AND RELATED ART STATEMENT

The present invention relates to a stable driving method for a display element comprising an organic thin-film light-emitting element.

Research on organic thin-film light-emitting elements has recently been conducted actively because of the need for low-drive voltages that emit light and enable light-emitting colors to be selected by applying various light-emitting materials (for example, see U.S. Pat. No. 3,530,325). Such research has been further encouraged by reports that a brightness of 1,000 Cd/m$^2$ or higher could be achieved at a drive voltage of 10 V or less by using a laminated organic thin-film light-emitting element consisting of an anode, positive hole injection layer, light-emitting layer and cathode in order to improve light-emitting efficiency (for example, see U.S. Pat. No. 4,356,429).

FIG. 9 is a cross-sectional view showing a conventional organic thin-film light-emitting element. An anode 2 that is a transparent conductive film, a positive hole injection layer 3 that is an organic material, a light-emitting layer 4, an electron injection layer 5, and a cathode 6 that is a metallic material are formed on a transparent substrate 1 that acts a support. The cathode 6 also has a function for reflecting light from the light-emitting layer 4 to improve efficiency in outputting light from the substrate 1.

FIG. 10 is a cross-sectional view showing a different conventional organic thin-film light-emitting element. In this element, the light-emitting layer 4' also incorporates the function of the electron injection layer 5.

In the conventional organic thin-film light-emitting elements as described above, the resistance of the element increases as light is continuously emitted. Thus, if the element is continuously driven at a constant voltage, the current flowing through pixels will decrease and the emitted light will be significantly attenuated.

In addition, the degree of increase in the resistance of the element differs in each pixel, and if the element is continuously driven at a constant voltage, after-image will appear that reflects the degradation of each element, thereby causing the screen to get fixed.

When an attempt is made to execute gradation display required for high-quality display by using the brightness of the element, if a control is made through the supply voltage for the element, the small range of control voltage will cause the screen to become clearly fixed depending on the degree of the degradation of each pixel. This results in the degradation of display quality.

Referring to FIG. 3, which is a diagram showing the relationship between the current flowing through a pixel and the applied voltage, a characteristic line 11 shows a current voltage characteristic in the initial phase of driving, while a characteristic line 12 shows one after a specified period of time has passed. The relationship 11 between the applied voltage and current during the initial phase of driving is basically similar to an exponential function, and the current rises rapidly with the voltage. As the driving time increases, the characteristic line 12 varies as shown at 12. When the driving is continued at the initial voltage 13, the current decreases from an initial value 14 to a value 15. The organic thin-film light-emitting element emits light due to the recombination of injected charges. The efficiency decreases due to the degradation associated with the driving, but is basically proportional to the value of the current. Thus, the amount of emitted light decreases rapidly with the current. Consequently, as the general methods for driving an organic thin-film light-emitting element, driving is made while maintaining the voltage flowing through the overall element at a constant level. In this case, the element is driven by increasing the applied voltage 16 in order to maintain the initial value 14.

FIG. 4 is a diagram showing the relationship between the brightness and driving time of an organic thin-film light-emitting element. A characteristic line 10 shows the characteristic obtained when the element is driven at a constant current, whereas a characteristic line 9 shows the characteristic obtained when the element is driven at a constant voltage. As shown in FIG. 4, when the element is driven at a constant current, the efficiency decreases and the brightness gradually decreases over time. The degradation of the characteristic is significantly smaller than that when it is driven at a constant voltage.

If, for example, the element shown in FIG. 10 is used, the brightness will decrease by half in about 20 hours when the element is continuously driven at an initial brightness of 100 Cd/m$^2$ and a constant voltage. On the contrary, when the element is driven in such a way that the voltage is compensated for so as to provide a constant current, the same element will not have brightness reduced by half until about 500 hours have passed. It is thus well known that driving the element at a constant current is effective in increasing the life expectancy of the organic thin-film light-emitting element.

The method of driving the element at a constant current, however, is effective in increasing the life expectancy of the element, but can not prevent the fixing of the screen caused by the non-uniform degradation of the pixels. In addition, this method fails to provide a high-quality display with gradations.

The invention has been made in view of these problems, and its object is to improve the constant-current driving method to provide a display-element driving method that is unlikely to cause the screen to get fixed and that can ensure high-quality display.

SUMMARY OF THE INVENTION

According to this invention, the above object can be achieved using a method for driving a display element of an organic thin-film light-emitting element. The method is formed of measuring a current flowing through each of the pixels constituting a display element, and controlling the current flowing through each pixel so as to be maintained at a specified value required for display operation.

In the above invention, effective control is provided by manipulating the supply voltage for each pixel prior to a display operation or by manipulating the supply voltage for each pixel simultaneously with a display operation.

Since the degree of degradation differs in each pixel, the display element comprising organic thin-film light-emitting elements is controlled in such a way that the voltage applied to each pixel is manipulated so as to provide a specified current value for each pixel. The current value is controlled at a specified value by constant value control and additional value control for varying the light-emitting efficiency. This compensates for the non-uniformity of the degradation of the pixels caused by variations in resistance or light-emitting efficiency. Additional value control with a gradation signal enables high-quality graduation display of the display element.

Each pixel is scanned by using a combination of an anode and a cathode as a combination of a scanning line and a data line.

The current for each element is controlled by individually manipulating and setting the supply voltage for each element prior to a display operation, then performing a display operation in order to maintain the current at a specified value. The current can also be controlled by manipulating the supply voltage for each pixel simultaneous with a display operation in order to maintain the current at a specified value.

In the method of individually manipulating the supply voltage for each element prior to a display operation and then performing a display operation, a resistor element is additionally inserted in series with an element drive power supply; the current flowing through the pixel when the voltage is reduced by the resistor element is measured, and an operation for adjusting the voltage applied to the pixel is performed prior to a display operation.

In the method of controlling the current simultaneously with a display operation, a constant-current circuit comprising, for example, a transistor can be used to perform a fast display operation.

Since the brightness of the organic thin-film light-emitting element is proportional to the current, gradation display can be provided by inputting a gradation current signal prior to or simultaneous with a display operation.

DETAILED DESCRIPTION OF PREFERRED EMBODIMENTS

Embodiment 1

The display element was of the VGA class with a diagonal size of 10.4 inches and having 640×480 pixels. The screen was divided into two parts, each having 640×240 pixels, and scanned at a frequency of 60 Hz. The scanning line comprised cathodes having 240 lines. The data line comprised anodes of the organic thin-film light-emitting element having 640 lines.

Figure 5:
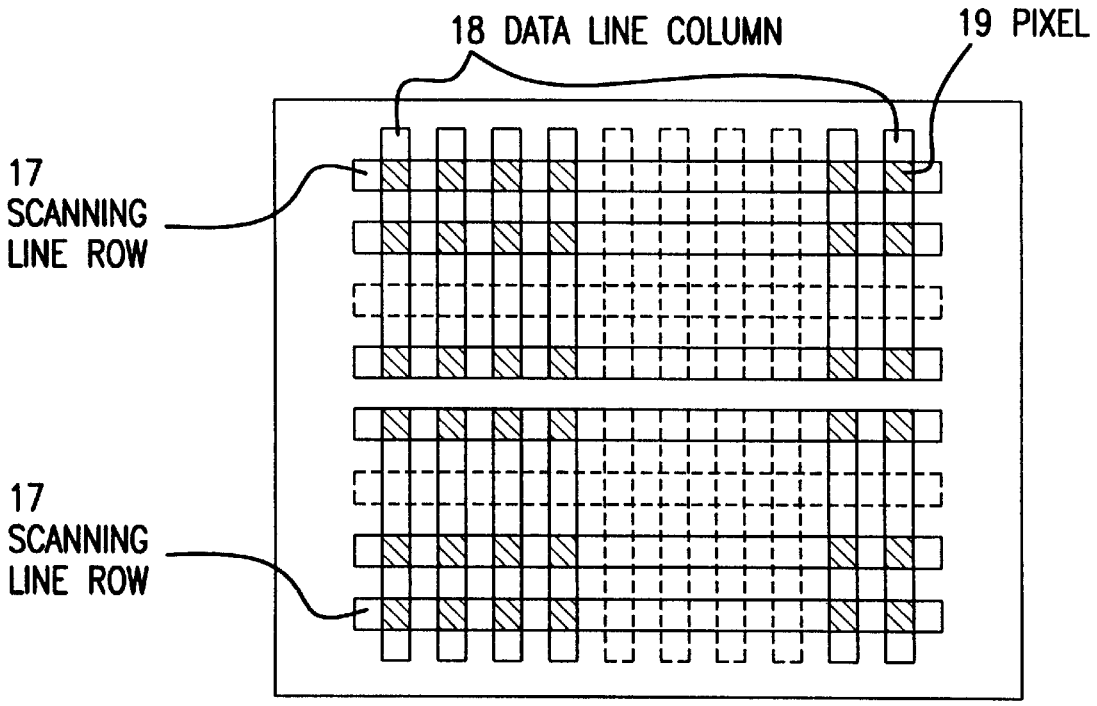
FIG. 5 is a diagram showing pixels and lines of an embodiment of the display element of the invention.

FIG. 5 shows the integral part of the display element according to this embodiment, showing the pixels, and line rows and columns. The solid intersection between a data line column 18 and a scanning line row 17 constitutes a pixel 19.

The element was made by forming a pattern of anodes 2 on a planar glass substrate with a thickness of 0.5 mm and forming positive hole injection layers 3 and light-emitting layers 4 which are organic layers. The organic layers have a thickness of 50 and 70 nm, respectively. The positive hole injection layer 3 and the light-emitting layer 4 comprise diamine and alumichelate compounds, respectively.

Chemical formula 1

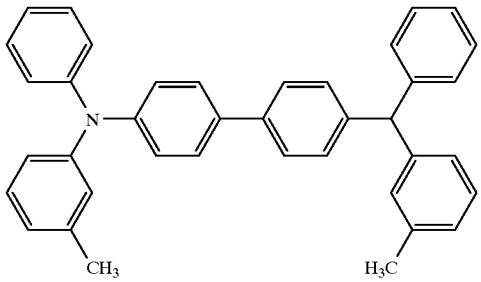

Chemical formula 2

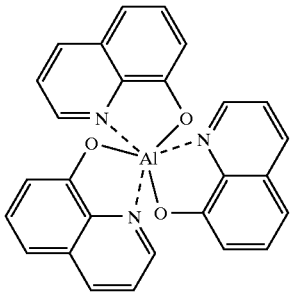

A pattern of cathodes 6 was formed so as to have a thickness of 200 nm. The cathode 6 comprised an MgIn alloy (In contents: 5 vol. %). Finally, glass wool impregnated with fluorocarbon resin was formed as a sealing layer 7. A measuring and power supply circuit 28 was connected to each of the data line columns of the display element configured in this manner.

Figure 1:
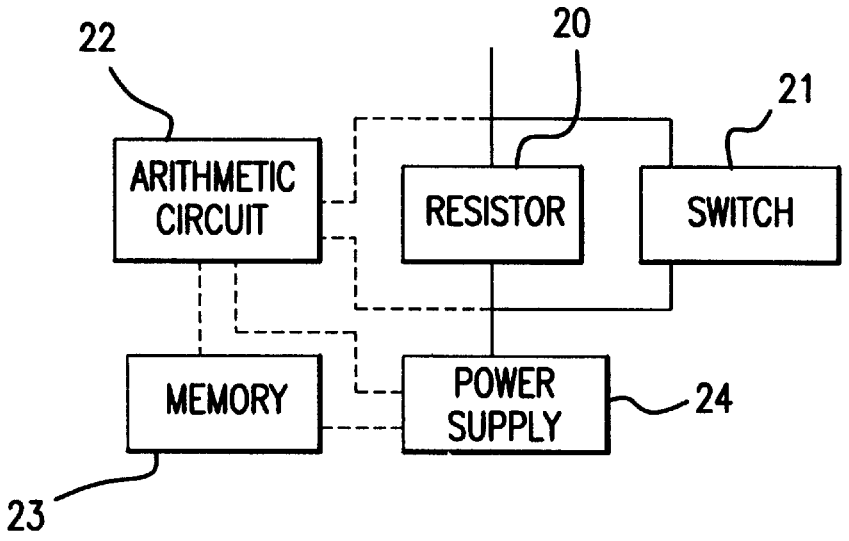
FIG. 1 is a block diagram showing a measuring and power-supply circuit of a display element according to an embodiment of this invention.
Figure 2:
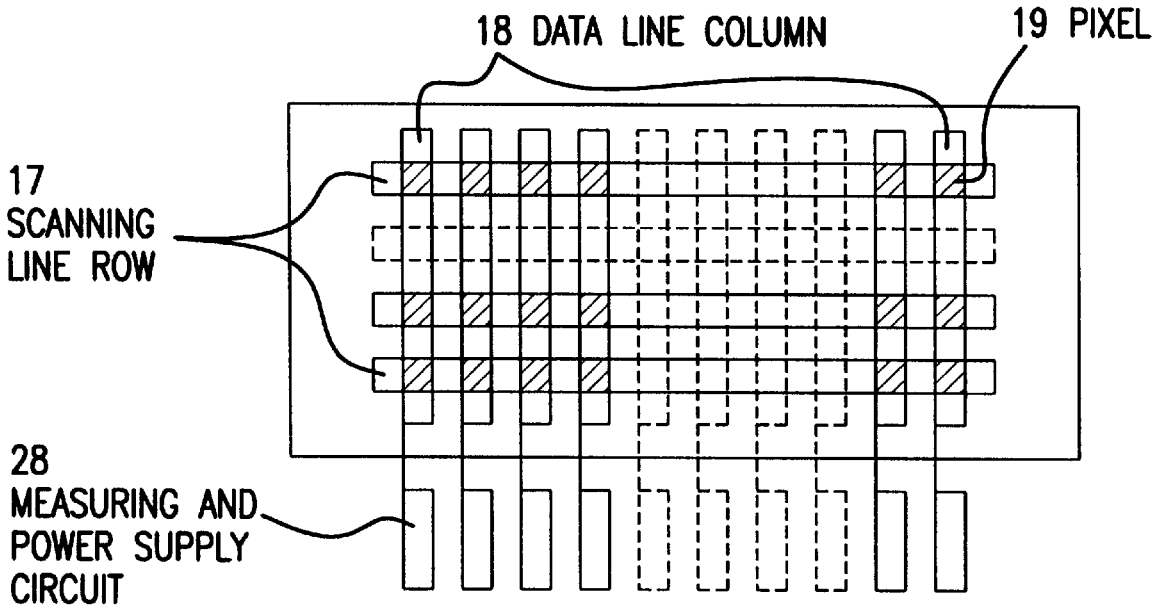
FIG. 2 is a block diagram showing the connection of the measuring and power-supply circuit of the display element according to an embodiment of this invention.
Figure 3:
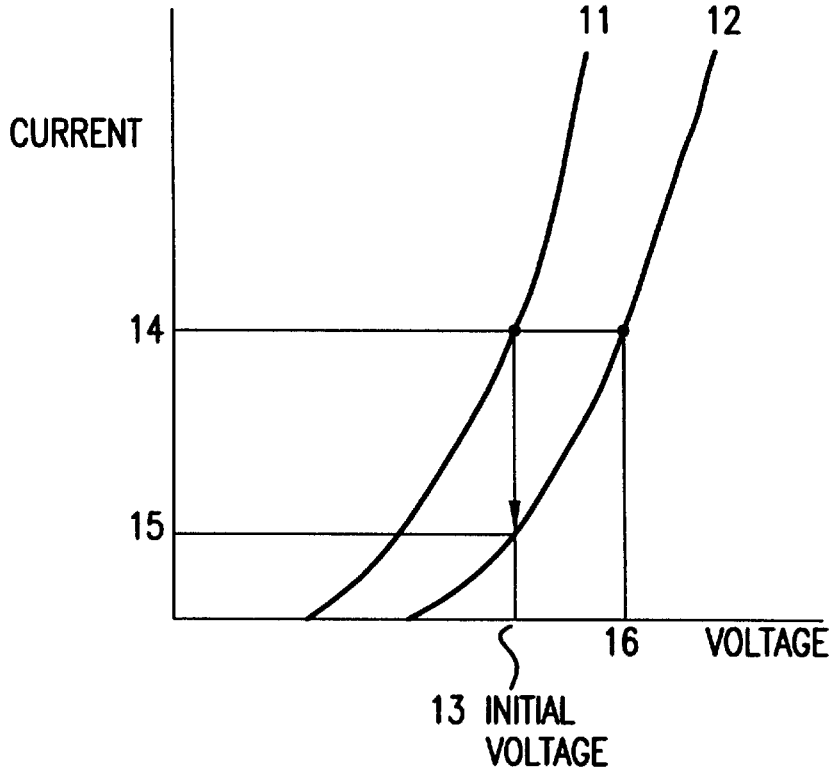
FIG. 3 is a diagram showing the relationship between a current flowing through a pixel and an applied voltage.
Figure 4:
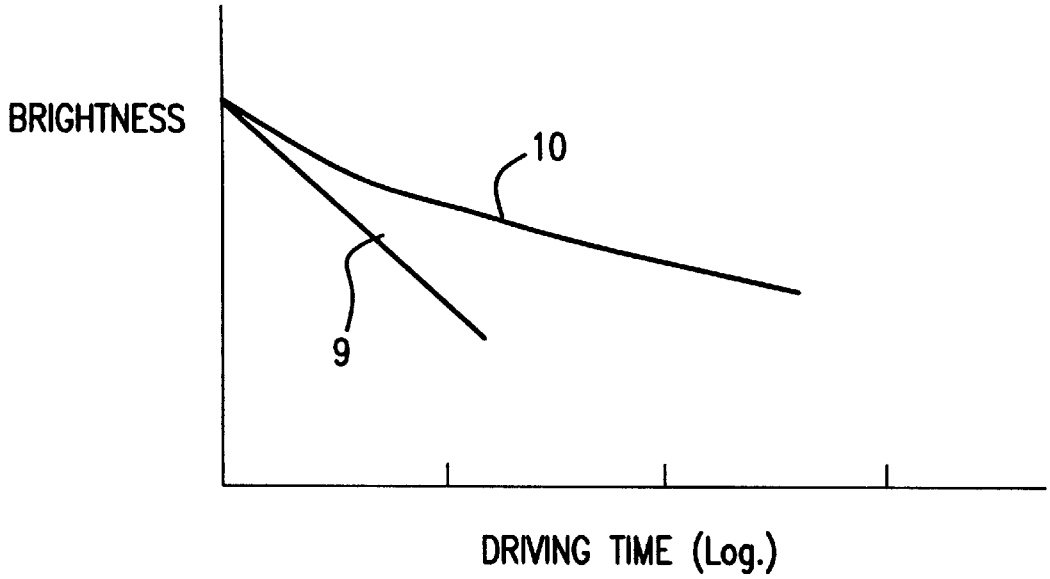
FIG. 4 is a diagram showing the relationship between the brightness and driving time of an organic thin-film light-emitting element.

FIG. 1 shows the measuring and power-supply circuit of the display element, while FIG. 2 shows the connection of the measuring and power-supply circuit of the display element according to this embodiment.

During a display operation, a switch 21 is turned on so that a current from a power supply 24 flows through the switch 21 and is supplied to the pixels of the display element. No current flows through a resistor 20. When the switch 21 is turned off, the current flowing to the pixels is measured, and the current is supplied to the pixels through the resistor 20. Based on the difference in potential between both ends of the resistor 20, an arithmetic circuit 22 performs the following operations:

$i = V_0 / R_0$ $R_0$: Resistance of resistor 20

$V_0$: Difference in potential between both ends of resistor 20

$i$: Current flowing to pixels $V_1 = V_2 - V_0$ $V_2$: Supply voltage during measurement operation $V_1$: Supply voltage during display operation The value i obtained by the measurement is compared to a specified value $i_1$ of a current flowing to the pixels in order to correct a supply voltage $V_2$ and a measuring operation is performed again. When the difference between $i_1$ and i becomes within an allowable range, $V_1$ is set as the supply voltage and stored in a memory 23. During the subsequent measuring operation, the initial value of $V_2$ can be set at $V_1+i+R_0$ to finish the measurement quickly.

The measuring and power-supply circuit 28 is attached to each line on a one-on-one basis to reduce the measurement time. The supply voltage for the pixels is manipulated, set, and stored prior to each pixel display operation. If the measurement operation comprising the manipulation, setting, and storage of the supply voltage is independently performed prior to the display operation, the measurement and display operations can be separated from each other to perform the display operation stably at high speed. In addition, the additional resistor required to measure the current can be disconnected during the display operation to reduce power consumption. In the display element, the light emitted from each pixel is determined by the number of scanning lines in the panel, the scanning frequency, and the need for gradation display due to temporal division. Since, for example, VGA-class display elements have pulsed-light emission for 70 microseconds or less, the driving of the current requires fast responses. Since the degradation of the element occurs very slowly compared to the time region of the driving pulse, the compensation for degradation need not be fast. The measurement of the current characteristic of each pixel by using an additional resistor element can be executed prior to the use of the display element or as required using a sticking prevention switch.

Embodiment 2

A display element was of the ¼ VGA class with a diagonal size of 5.2 inches and 320×240 pixels. A screen was divided into two parts each consisting of 320×120 pixels and scanned at a frequency of 60 Hz. A scanning line comprises cathodes of the organic thin-film light-emitting element having 120 lines. A data line comprise anodes of the organic thin-film light-emitting element having 320 lines.

The element was produced by the same method as in Embodiment 1.

Figure 6:
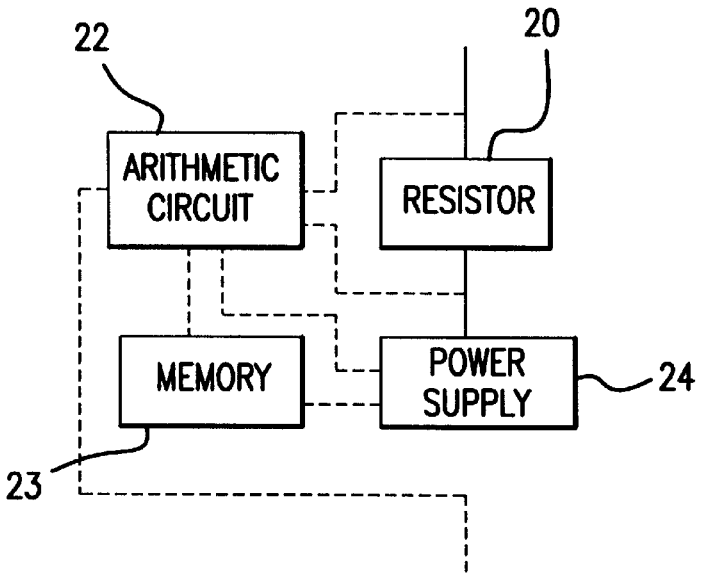
FIG. 6 is a block diagram showing a measuring circuit of a display element according to a different embodiment of the invention.
Figure 7:
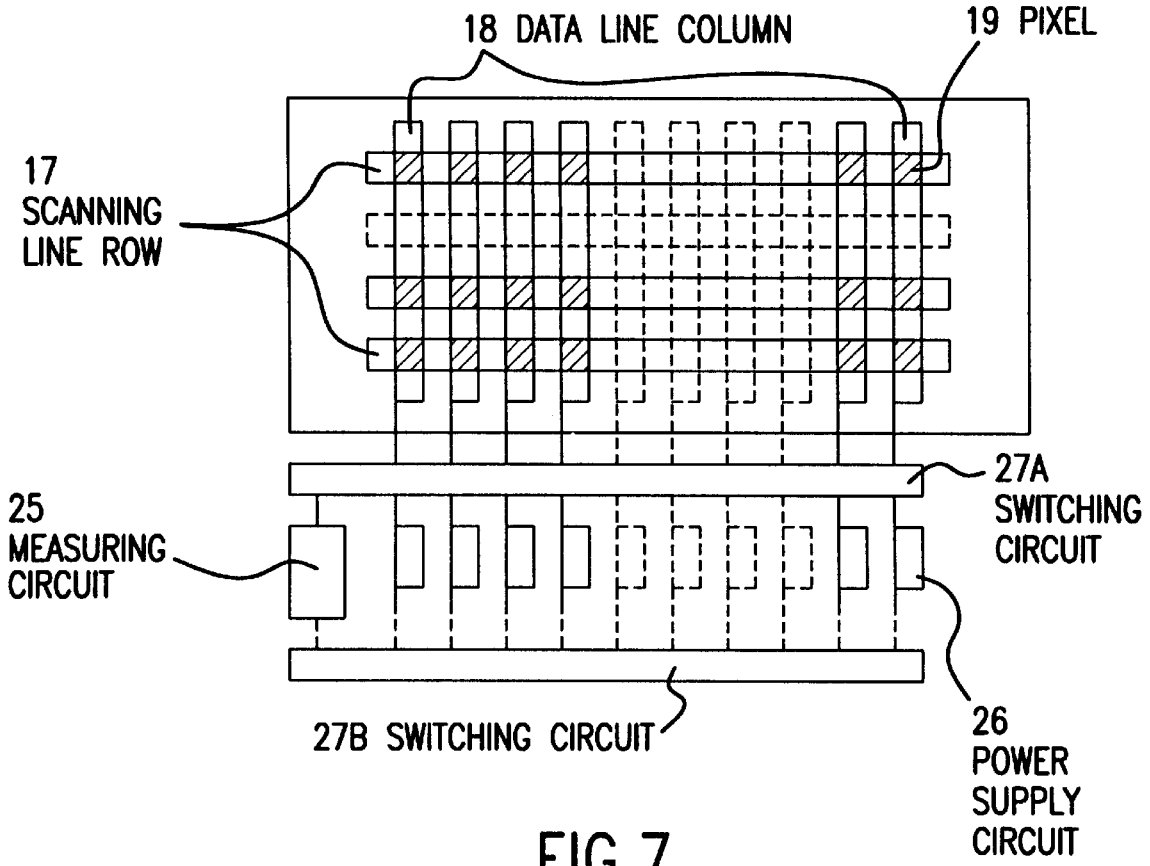
FIG. 7 is a block diagram showing the connection of the measuring circuit of the display element according to the embodiment of the invention.

FIG. 6 shows a display element measuring circuit while FIG. 7 shows the connection of the display element measuring circuit according to this second embodiment of the invention.

A measuring circuit 25, power-supply circuits 26, and switching circuits 27A and 27B are attached to a data line column. The measuring circuit 25 provides the same functions as the measuring and power-supply circuit 28 shown in Embodiment 1, and the results of mathematical operations are transferred to the power-supply circuits 26 of the respective data line columns. The switching circuits 27A and 27B have the function of switching between the display and measurement operations and sequentially scanning the measurement operation of each data line column. This method is advantageous in that it only requires a set of measuring circuits instead of a measuring circuit for each line.

In addition to the above embodiments, a plurality of measuring circuits 25 can be used to execute a method having intermediate functions between Embodiments 1 and 2.

Embodiment 3

The construction and production of the element is the same as described in Embodiment 2.

Figure 8:
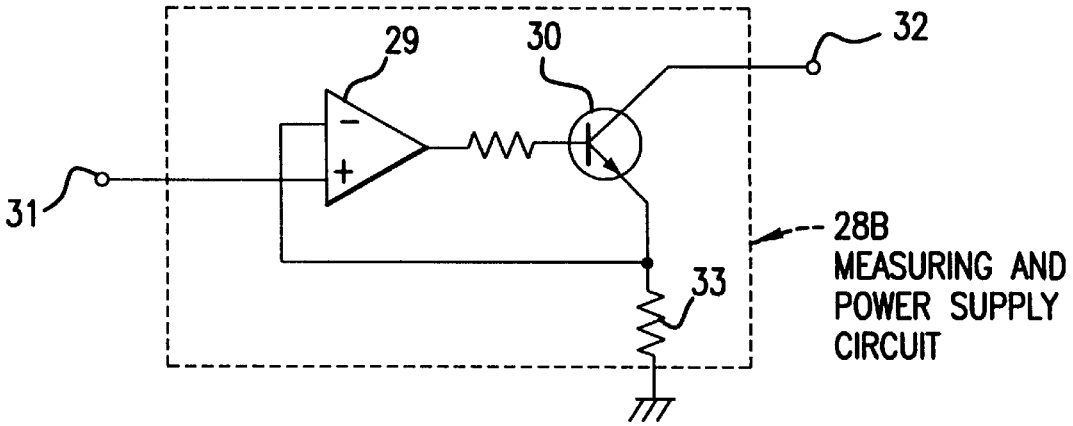
FIG. 8 is a connection diagram showing a measuring and power-supply circuit of a display element according to a different embodiment of this invention.
Figure 9:
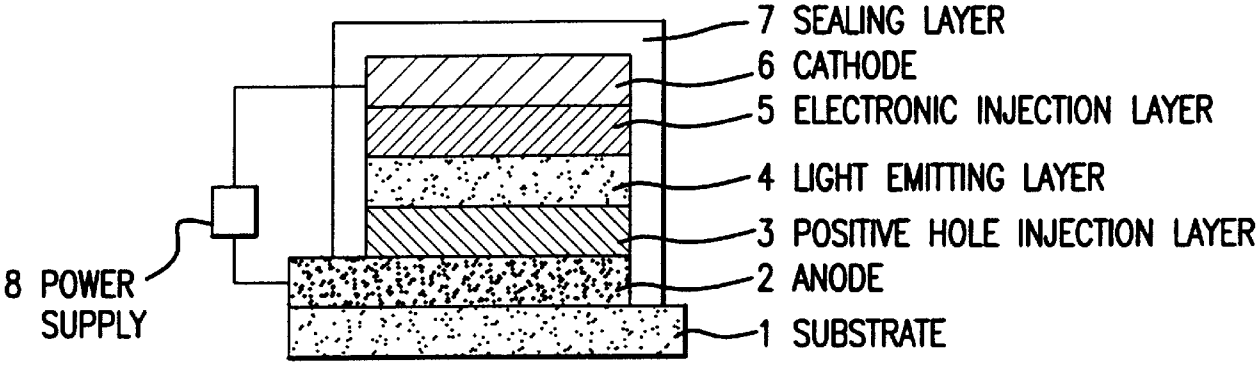
FIG.9 PRIOR ART
FIG. 9 is a cross-sectional view showing a conventional organic thin-film light-emitting element.
Figure 10:
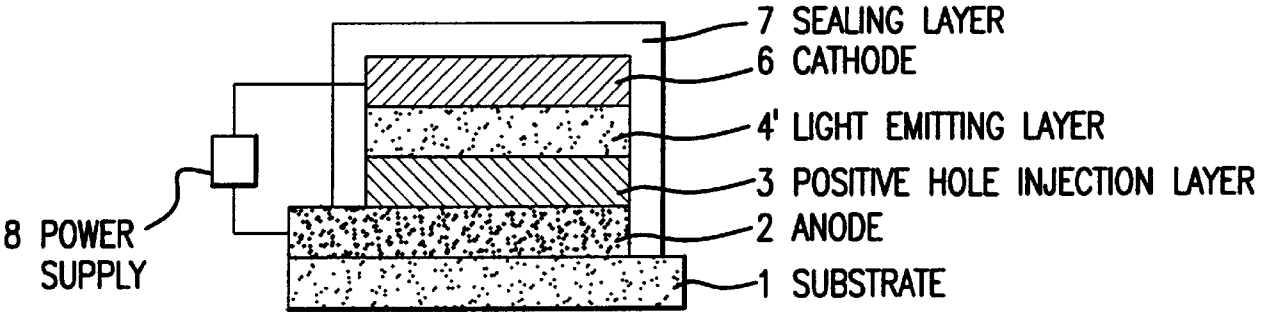
FIG.10 PRIOR ART
FIG. 10 is a cross-sectional view showing another conventional organic thin-film light-emitting element.

FIG. 8 is a connection diagram showing a measuring and power-supply circuit of a display element according to the third embodiment of the invention.

As is shown in FIG. 8, a measuring and power-supply circuit 28B is attached to each line instead of the measuring and power circuit 28 described in FIG. 2. The measuring and power-supply circuit 28B is a voltage-current conversion circuit. The input is digital data. The measuring and power-supply circuit 28B is described below in detail.

A control (gradation) voltage signal from a drive circuit 31 is sent to the positive input of an operational amplifier 29. The output of the operational amplifier 29 is connected to the base of a transistor 30. The emitter of the transistor 30 is grounded via a resistor 33. The collector of the transistor 30 is connected to the cathode of a pixel 32. The operational amplifier 29 operates to vary the base potential of the transistor until the potential Vi of the control (gradation) voltage signal equals the emitter potential of the transistor 30. The collector current is thus adjusted so that the emitter potential is always equal to the input, and then flows through pixels. The resistance value of the resistor 33 and the power loss of the transistor adjust the supply voltage. A scanning circuit connected to the positive pole of the organic thin-film light-emitting element comprises a normal FET to perform switching operations.

Embodiment 4

Embodiment 4 is the same as Embodiment 3 except that a DA converter is used as the drive circuit 31 with its output connected to the positive input of the operational amplifier 29 in order to execute gradation display. The output of the DA converter may generate a voltage proportional to the gradation. In this case, the brightness of the organic thin-film light-emitting element is proportional to the gradation input, thereby enabling gradation display to be emitted easily.

According to the invention, a current flowing through each of the pixels constituting a display element is measured to control the current so as to be maintained at a specified value required for a display operation. Thus, if the degree of degradation differs in each pixel as in the display elements using the organic thin-film light-emitting elements, the current value for each pixel is controlled so as to be maintained at the specified value to compensate for the non-uniform degradation of the pixels caused by variations in resistance or light-emitting efficiency. In addition, additional value control with a gradation signal enables high-quality gradation display of the display element.

What is claimed is:

1. A method for driving a display element having light-emitting elements with a plurality of pixels, comprising:

measuring currents flowing through the respective pixels for constituting the display element in using the display element, controlling each of the currents flowing through the pixels by manipulating supply voltage for each pixel prior to a display operation, and maintaining the currents for the respective pixels at values required for the display operation to compensate non-uniform degradation.

2. A method for driving a display element having light-emitting elements with a plurality of pixels, comprising:

measuring currents flowing through the respective pixels for constituting the display element in each operation of the pixels in using the display element, controlling each of the currents flowing through the pixels by manipulating supply voltage for each pixel simultaneous with a display operation, and maintaining the currents for the respective pixels at values required for the display operation to compensate non-uniform degradation.

3. A method for driving a display element according to claim 1, wherein said light-emitting elements are organic thin-film light-emitting elements.

4. A method for driving a display element according to claim 1, wherein said light-emitting elements include data lines and scanning lines crossing each other so that the pixels are formed at crossing sections of the data lines and scanning lines, measuring and power-supply circuits being attached to the respective data lines to supply electricity and to measure the currents.

5. A method for driving a display element having light-emitting elements with a plurality of pixels, comprising:

preparing said light-emitting elements to include data lines and scanning lines crossing each other so that the pixels are formed at crossing sections of the data lines and scanning lines, and measuring and power-supply circuits attached to the respective data lines to supply electricity and to measure currents, each of the measuring and power supply circuits including a power source, a switch and a resistor which are connected to the power source so that when the switch is turned on, the current is supplied to the light-emitting element through the switch, and when the switch is turned off, the current flows through the resistor to measure the current, measuring the currents flowing through the respective pixels for constituting the display element, and maintaining the currents for the respective pixels at values required for display operation.

6. A method for driving a display element according to claim 5, wherein each of the measuring and power supply circuits further includes an arithmetic circuit connected to the resistor to measure the current, and a memory connected to the arithmetic circuit to memorize a value of the current measured at the arithmetic circuit.

7. A method for driving a display element according to claim 1, wherein a step of measuring the currents flowing through the respective pixels includes:

measuring a voltage drop $V_0$ of a resistance $R_0$ connected in series to a pixel to thereby measure a current i flowing to the pixel by an equation of $i=V_0/R_0$, comparing the current i with a predetermined current value $i_1$ to be applied to the pixel, regulating a supply voltage $V_2$ to the pixel so that a difference between the current i and the current value $i_1$ becomes within a predetermined range, setting a supply voltage $V_1$ to the pixel by an equation of $V_1=V_2-V_0$, and memorizing the supply voltage $V_1$.

8. A method for driving a display element according to claim 2, wherein said supply voltage is obtained by a constant-current circuit having a transistor and an operational amplifier.

9. A method for driving a display element according to claim 8, wherein an emitter, a base and a collector of the transistor are connected respectively to a negative input and an output of the operational amplifier, and each of the pixels, and when a control signal from a drive circuit is applied to a positive input of the operational amplifier, a collector current of the collector is adjusted so that an emitter potential is equal to the input, an adjusted collector current flowing through the pixel connected to the collector.

10. A method for driving a display element according to claim 2, wherein said light-emitting elements are organic thin-film light-emitting elements.

11. A method for driving a display element according to claim 5, wherein said light-emitting elements are organic thin-film light-emitting elements.

* * * * *

UNITED STATES PATENT AND TRADEMARK OFFICE

CERTIFICATE OF CORRECTION

PATENT NO. : 5,949,194

DATED : September 7, 1999

INVENTOR(S) : Haruo Kawakami, Yotaro Shiraishi, Makoto Kobayashi

It is certified that error appears in the above-identified patent and that said Letters Patent is hereby corrected as shown below:

In column 4, line 2, change "element" to --elements--;

line 20, change Chemical Formula 1 as follows:

From:

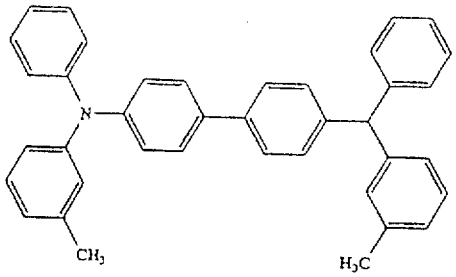

To:

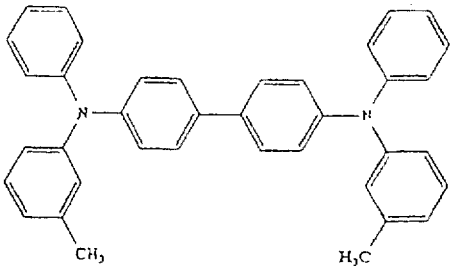

UNITED STATES PATENT AND TRADEMARK OFFICE

CERTIFICATE OF CORRECTION

PATENT NO. : 5,949,194

DATED : September 7, 1999

INVENTOR(S) : Haruo Kawakami, Yotaro Shiraishi, Makoto Kobayashi

It is certified that error appears in the above-identified patent and that said Letters Patent is hereby corrected as shown below:

In column 5, line 54, change "element" to --elements--;
line 56, change "element" to --elements--;
line 65, change "a data" to --data--; and
line 66, change "column" to --columns--.

Signed and Sealed this
First Day of February, 2000

*Attest:*

*Attesting Officer*

Q. TODD DICKINSON

*Acting Commissioner of Patents and Trademarks*